United States Patent [19]

Safford et al.

[11] Patent Number: 5,036,880

[45] Date of Patent: Aug. 6, 1991

[54] HIGH EFFICIENCY PLATE VALVE FOR RECIPROCATING COMPRESSOR

[75] Inventors: George J. Safford; Gene R. Bluhm, both of Quincy, Ill.

[73] Assignee: Cooper Industries, Houston, Tex.

[21] Appl. No.: 476,898

[22] Filed: Feb. 8, 1990

[51] Int. Cl.[5] ..... F16K 15/08; F16K 15/12

[52] U.S. Cl. ..... 137/516.21; 251/368

[58] Field of Search ..... 137/516.11, 516.15, 137/516.17, 516.19, 516.21, 516.23; 251/368

[56] References Cited

U.S. PATENT DOCUMENTS

| | | | |
|---|---|---|---|
| 2,090,486 | 8/1937 | Richardson | 137/516.21 |
| 4,318,425 | 3/1982 | Marks | 251/368 X |
| 4,495,964 | 1/1985 | Bennitt | 137/516.15 X |
| 4,889,156 | 12/1989 | Woollatt | 137/516.21 X |

*Primary Examiner*—Robert G. Nilson

*Attorney, Agent, or Firm*—Laff Whitesel Conte & Saret

[57] ABSTRACT

A valve for reciprocating compressors generally comprising a seat member, a movable plate member, a flat spring plate, and a guard which are assembled as a unitary structure. The seat member and the plate member have linear fluid passage ports which are offset relative to each other. When the valve is in its normal sealing position, the plate member is pressed by linear spring fingers formed on the spring plate against the seat member causing the surface area of the plate member to block the linear fluid passage ports of the seat member. The plate member also has projections extending in a linear or circular direction to receive the spring fingers. When the pressure in the reciprocating compressor becomes sufficiently great, the plate member moves backwards against the spring plate allowing the fluid to move through the valve, including the linear fluid flow passages of both the seat member and plate member.

26 Claims, 4 Drawing Sheets

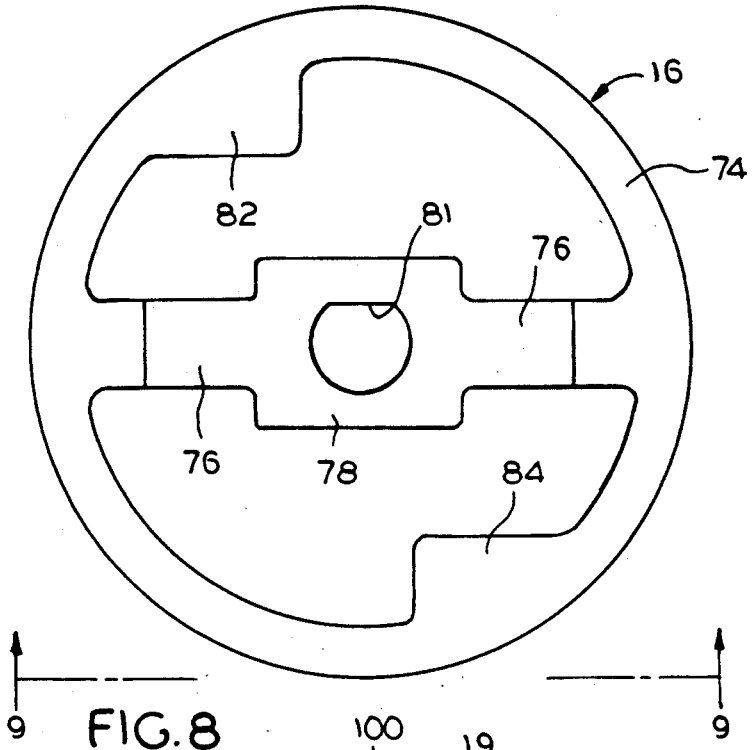
FIG. 8
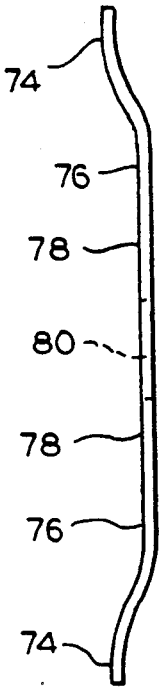
FIG. 9
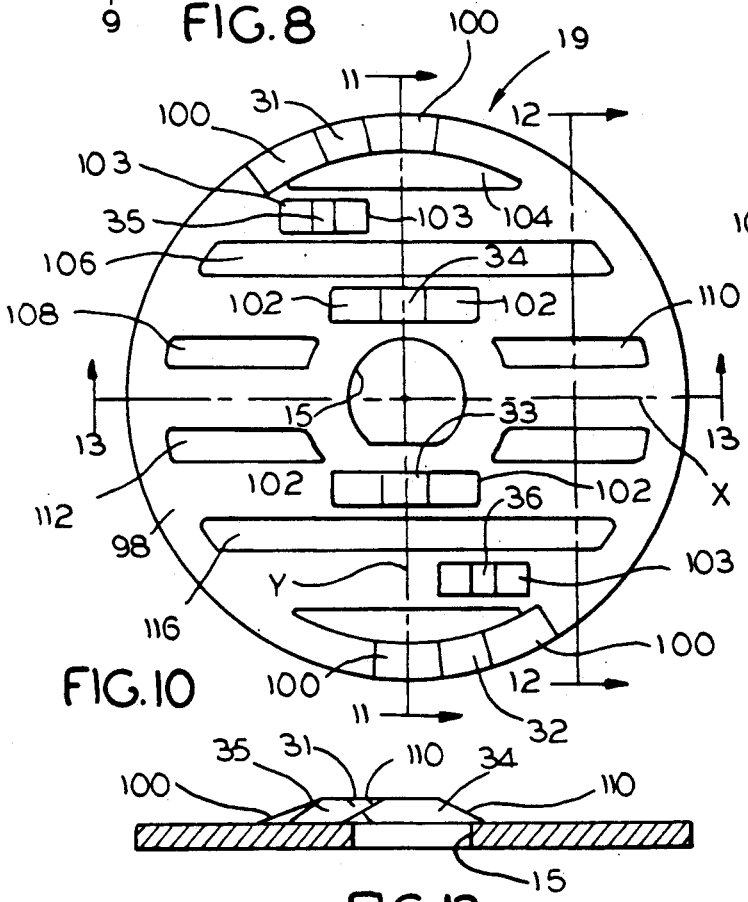
FIG. 10
FIG. 13
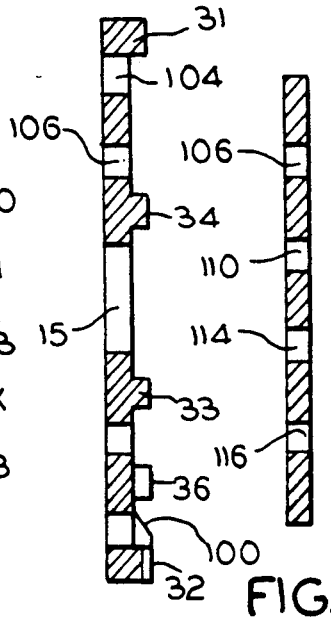
FIG. 11
FIG. 12

HIGH EFFICIENCY PLATE VALVE FOR RECIPROCATING COMPRESSOR

FIELD OF THE INVENTION

The present invention relates to reciprocating compressor plate valves and in particular to a compressor valve with improved reliability and efficiency and ease of assembly and adjustability. This invention also relates to the plate valve head, the plate valve spring, the valve plate and the vestial guard.

BACKGROUND OF THE INVENTION

Suction or pressure valves for use in a reciprocating compressor are heretofore known which are constructed with a valve seat having concentrically arranged, ring-shaped fluid flow passages An example is an invention co-invented by George J. Safford, which is disclosed in European patent application No. 303828, published Feb. 22, 1989. This application shows a seat, a movable plastic valve plate, a flat spring and a guard. The seat has concentrically arranged, ring-shaped, fluid flow passages which are countersunk. The movable plate also has concentrically arranged, arcuate-shaped fluid flow passages which are offset relative to the circular countersunk fluid flow passages of the seat. The top surface of the valve plate has a plurality of arcuate projections extending vertically therefrom. The bottom surface of the plate is flat and has land areas which cover the seat passages and will sealingly engage the seat. The spring has a plurality of arcuate resilient spring fingers. The arcuate spring fingers are positioned to contact projections and normally bias the plate against the fluid passages to maintain a sealed relationship between the plate and seat to prevent fluid from passing through the seat passages. When the pressure becomes sufficiently great in the seat passages, the fluid acts against the plate and forces it outward against the spring. This opens both the seat and plate fluid flow passages to allow the fluid to pass through the valve. A guard is located on the outward side of the spring. The spring is between the plate and the guard. The guard has an annular side wall that contacts the seat. The guard acts as a stop for the plate and serves as a support for the spring. When the pressure decreases sufficiently, the spring fingers force the plate bottom surface against the seat passages and, once again, the plate is in a sealing relationship with the seat.

Other spring members heretofore known include a coiled spring as disclosed in U.S. Pat. Nos. 4,307,751 and 4,184,508, a curved spring plate as disclosed in U.S. Pat. No. 3,945,397 or a flat spring which also serves as the plate member as disclosed in U.S. Pat. No. 4,164,238.

A shortcoming of some prior art reciprocating compressor valves is that the plate lift is limited due to the cyclical impact on the guard by the plate which causes the plate to undergo fatigue and metal cracking. Attempts to solve this shortcoming have been to increase the area and strength of the sealing portions of the plate, but such a design decreases the fluid, i.e, air flow. In addition, the guard used with the prior art valves must have sufficient thickness to contain and fasten the coil springs. A thinner guard is desired, however, to allow for greater fluid flow.

A shortcoming of the prior art valve which uses the flat circular spring is that its diameter is restricted in size to, typically, greater than 5 inches. The arcuate spring fingers design pose the restriction because a reduced diameter for the fingers requires shorter spring fingers which, at high lift, causes higher strains leading to finger breakage. Alternatively, the finger length could be maintained the same, but the number of fingers would have to be reduced below values acceptable for preload.

SUMMARY OF THE INVENTION

Accordingly, an object of this invention is to provide a reciprocating compressor valve with increased efficiency and greater flexibility with regard to its use and repair. In keeping with this, this invention provides a compressor valve which has linear fluid flow passages in both its valve seat and movable valve plate.

The invention provides a compressor type valve which has a valve seat, a movable valve plate, a single flat circular spring positioned to urge the valve plate into sealing engagement with the valve seat. The valve seat has a plurality of chord fluid passages which extend substantially parallel to each other. The valve plate has a plurality chord fluid passages which preferably extend parallel to each other and are off-set from valve seat fluid passages. The spring also has a plurality of chordal extending spring fingers which are positioned to urge the valve plate into sealing engagement with the valve seat.

The invention also provides along with the above valve arrangement on irregular shaped steering stud which has a guide surface of predetermined length and a raised retention portion for holding the spring and guard stationary with respect to the steering stud. The valve plate and seat have corresponding irregular shaped orifices and bores, shaped as the steering stud to prevent rotational movement of the valve plate and seat relative to the steering stud and relative to each other.

The valve plate is a molded one-piece glass reinforced poly-ether-ether-ketone polymer. The spring fingers preferably have an even number of geometrically located spring fingers with each spring finger having an opposite counterpart. A majority of the spring fingers are linear or chordal.

The valve plate has corresponding projections which contact the spring fingers. The projections are sized and spaced to provide the desired spring action.

The guard does not have any side walls. This allows for greater movement of the valve plate and permits interchangeability and easy replacement of the spring. The guard has an annular rim with a diametrically extending center arm. The center of the center arm is lower than the annular rim. Also extending from the rim are a pair of diametrically opposed spring limiting surfaces.

The guard and spring are preferably fixed to the steering stud by a bolt or screw.

BRIEF DESCRIPTION OF THE DRAWINGS

Further advantages and features of the present invention will become more apparent from the following description of exemplary embodiments taken in conjunction with the drawings:

FIG. 8 is a top plan view of a vestial guard of the present invention.

FIG. 9 is a side perspective of the vestial guard of FIG. 9.

FIG. 10 is a top plan view of the valve plate of the present invention.

FIG. 11 is a cross sectional view taken along lines 11—11 of FIG. 10.

FIG. 12 is a cross sectional view taken along lines 12—12 of FIG. 10.

FIG. 13 is a cross sectional view taken along lines 13—13 of FIG. 10.

DETAILED DESCRIPTION OF THE INVENTION

Figure 1:
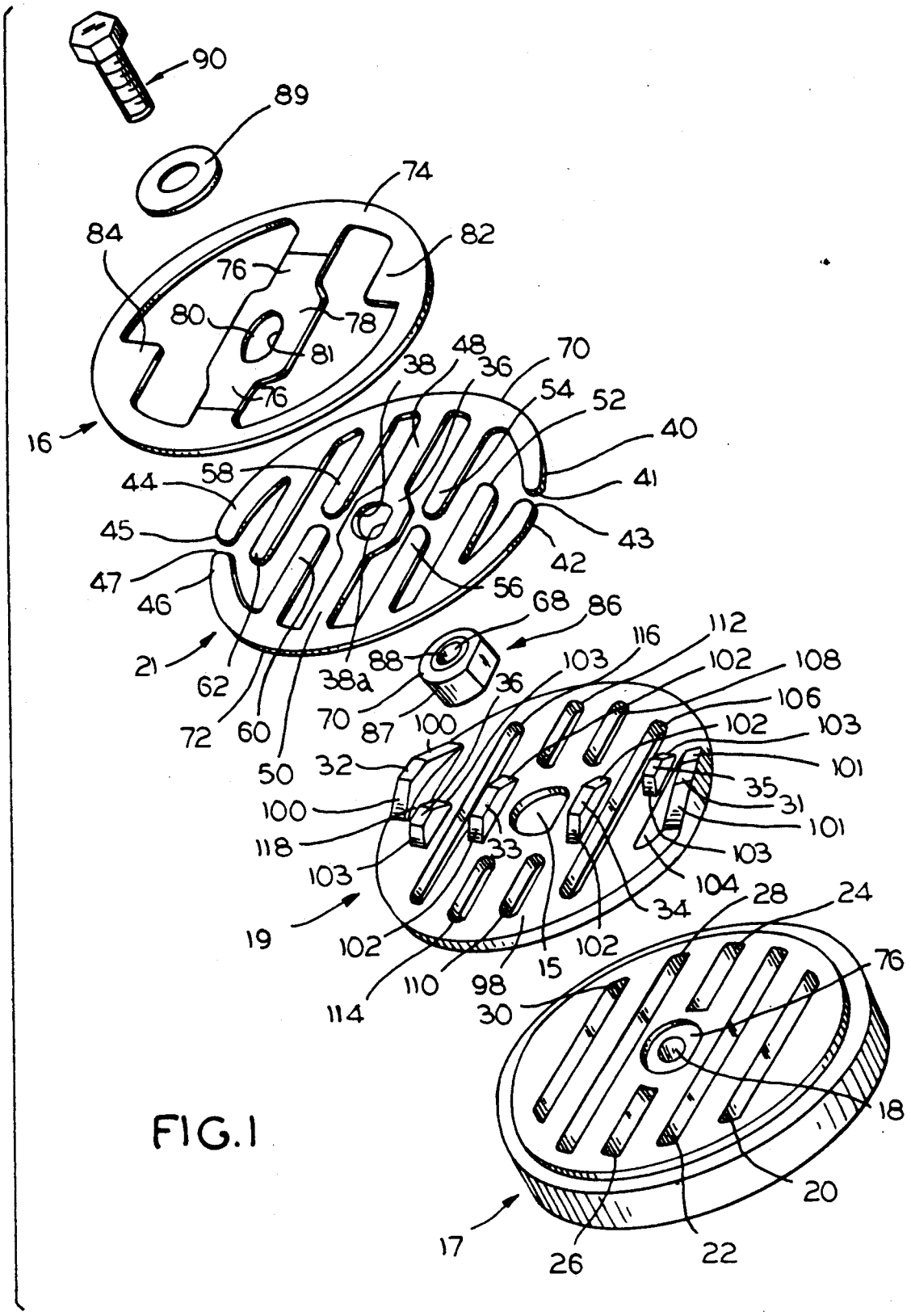
FIG. 1 is an exploded view of the compressor valve in accordance with the present invention.
Figure 2:
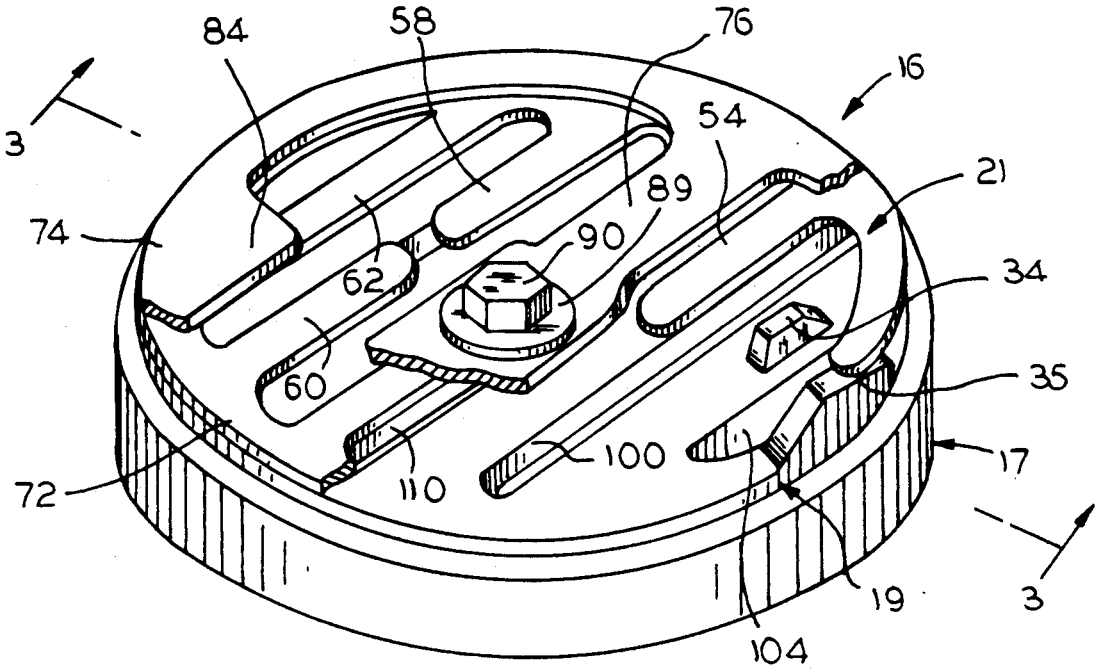
FIG. 2 is a perspective view, partly in cross-section, of the compressor valve of FIG. 1.
Figure 3A:
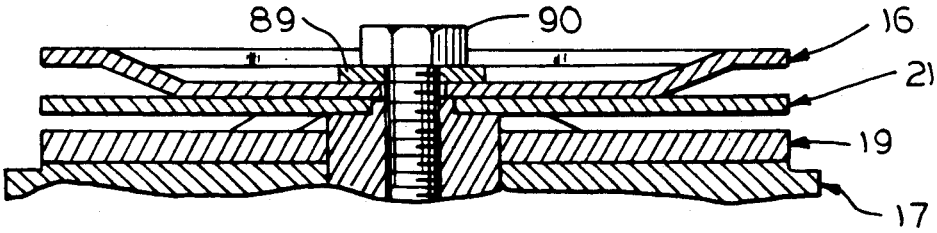
FIG. 3a is a partial vertical cross-section view taken along lines 3a—3a of FIG. 3.
Figure 3:
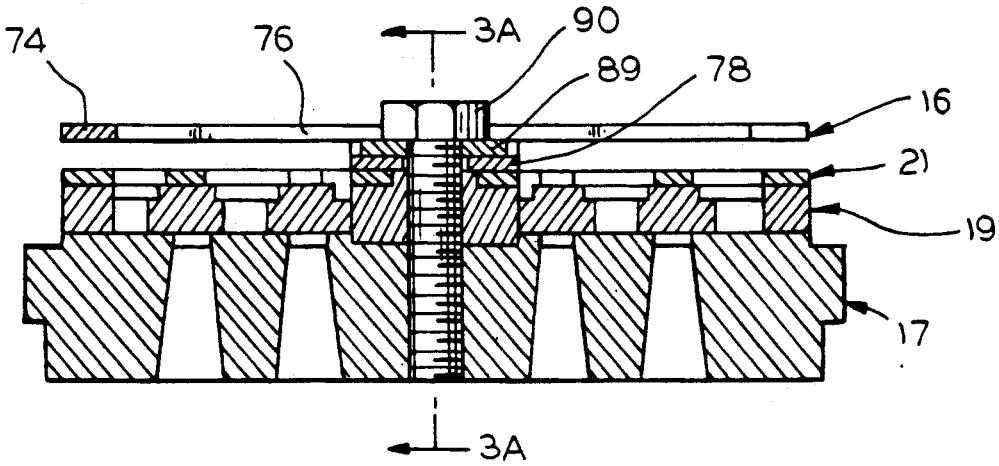
FIG. 3 is a partial vertical cross-section of the compressor plate valve taken along lines 3—3 of FIG. 2.

FIG. 1 shows our compressor valve separated with its components in their relative position to each other.

The valve has an annular valve seat 17, a movable annular valve plate 19 positioned above the seat, an annular flat spring 21, an annular guard 16, and a steering stud 86.

Figure 6:
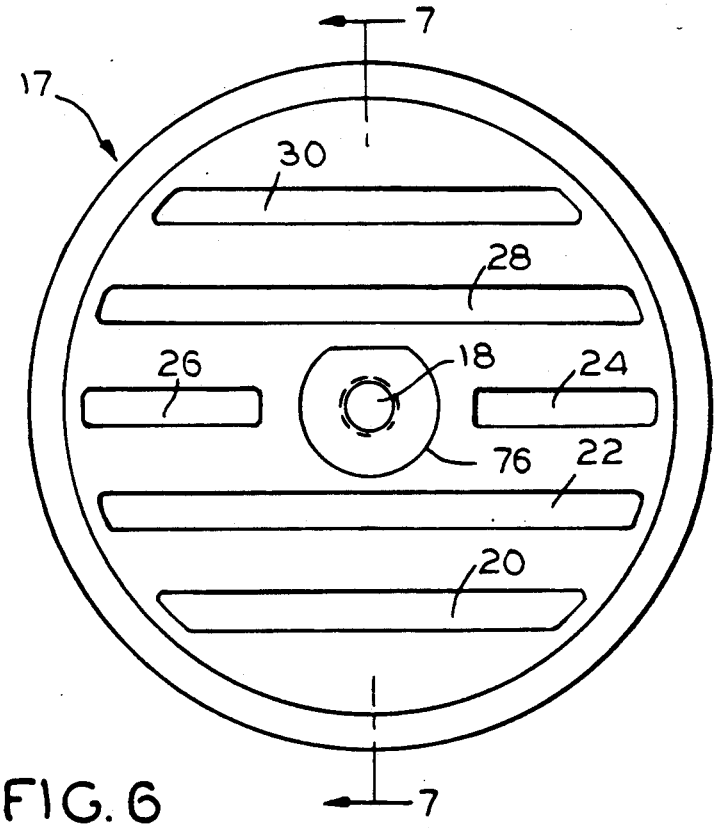
FIG. 6 is a top plan view of a valve seat of the present invention.
Figure 7:
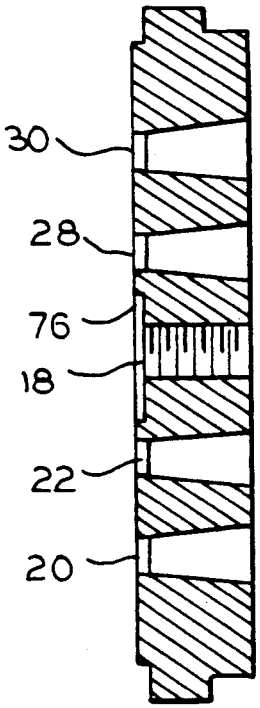
FIG. 7 is a cross sectional view taken along lines 7—7 of FIG. 6.

FIG. 1 and 6–7 show our annular valve seat 17.

Seat 17 is a circular plate having a central aperture 18 and an irregular shaped bore 76 surrounding the aperture on the upper surface of the seat.

The center aperture 18 may be threaded and generally extends through the seat 17.

The irregular bore has an arcuate portion and a straight portion. The depth of the bore 76 is sufficient to key thereto a portion of the corresponding steering stud 86.

A plurality of linear or chord extending passage ports 20, 22, 28 and 30 and radial ports 24 and 26 are formed in the seat.

Passage ports 20 and 30 are of equal size and are on opposite sides of the valve seat center. They extend parallel to each other and are spaced a predetermined distance from the perimeter of the valve seat;

- passage ports 22 and 28 are equal in size and longer than ports 20 and 30. The ports 22 and 28 extend parallel to each other and are opposite sides of the valve seat center. Ports 22 and 28 extend parallel to ports 20 and 30 and are positioned between ports 20 and 30;
- passage ports 24 and 26 extend radially from the valve seat center and are parallel to ports 20 and 30. Ports 24 and 26 are smaller than ports 20, 22, 28 or 30.

Preferably, seat 17 is fabricated from powdered metal and therefore requires little or no machining. The manufacture of the seat is more easily facilitated because the passage ports extend in a linear or chord direction.

FIGS. 1 and 10–13 show our circular movable valve plate 19. Movable plate 19 is a circular plate which includes an irregular shaped aperture 15. The aperture 15 is not threaded. The irregular shaped aperture has a flat side which acts as a key and/or guide surface.

The irregular shape of the aperture 15 corresponds to the outer shape of the steering stud 86. It is sized to allow the steering stud to pass through the aperture and permit the plate to move axially along the stud and not to rotate relative to the stud.

The plate 19 is configured to seal the linear fluid passage ports 20, 22, 24, 26, 28 and 30 of seat 17 when it abuts the seat.

The top surface 98 of the plate 19 has an X-axis and a Y-axis. Extending parallel to the X-axis and extending through the plate 19 are a plurality of linear or chordal fluid passage ports 104, 106, 108, 110, 112, 114, 116 and 118 which are offset relative to the fluid passage ports 20, 22, 24, 26, 28 and 30 of seat 17.

The ports 104 and 118 are equal in size and are adjacent the periphery of the plate 19. They are located equidistant from opposite sides of the X-axis;

- the ports 106 and 116 are equal in size and are located equidistant from opposite sides of the X-axis. The ports 106 and 116 are larger than the ports 104 and 118 and are positioned between the ports 104 and 118;
- the ports 108 and 114 are equal in size and are located equidistant from opposite sides of the X-axis and are also located equidistant from opposite sides of the Y-axis;
- the ports 110 and 112 are equal in size and are located equidistant from opposite sides of the X-axis and are also located equidistant from opposite sides of the Y-axis. The ports 108, 110, 112 and 114 are smaller than the ports 104 and 118.

The thickness of movable plate 19 may vary depending on the working pressure it is designed to encounter.

Two arcuate projections or nubs 31 and 32, extend upwardly from the periphery of the plate and are diametrically opposite each other. A plurality of linear or chord projections or nubs 33, 34 and 35, 36 are formed on the top of the plate;

- the nubs 31 and 32 are the same and each has inclined sides 100. The length of the flat top, the length of the inclined sides and the height and width of the nubs depend on the preload and load that is predetermined for the spring 21;
- the nubs 35 and 36 are the same size and extend upwardly from the top of the plate for a predetermined distance. They each have a flat top and inclined sides 103. The nubs 35 and 36 are diametrically opposite each other and their flat tops are located on opposite sides of the X and Y axis. The nubs 35 and 36 are between the nubs 31 and 32;
- the nubs 33 and 34 are the same size and extend upwardly from the top of the plate for a predetermined distance. They each have a flat top and inclined sides 102. The nubs 33 and 34 are diametrically opposite each other and they are located on opposite sides of the X axis and between the nubs 35 and 36.

The nubs 33 and 34 are longer than the nubs 35 and 36 and shorter than the nubs 31 and 32. The plate 19 top surface is adapted to face spring 21.

The nubs are sized to control spring tension and preload. They are also used to strengthen molding knit lines. The plate molding process typically results in weak points generally known as "knit lines" where two waves of liquid polymer meet while filling the mold. Under impact of millions of cycles fracture typically occur at such lines. Therefore, the spring nubs have been placed over the knit lines to add extra thickness and reinforcement. Further, by varying the height of the nubs, spring tension can be varied. Thus, by using a plate with different numbers and sizes of nubs, the spring tension can be varied, as desired.

The movable plate 19 is preferably constructed of 30% glass reinforced poly-ether-ether-ketone polymer. This glass reinformed polymer can withstand the high lift impacts to temperatures of 600° F. Further, the glass reinforced polymer is chemically inert to practically all known effluents. It is subject to attack by concentrated nitric and sulfuric acid.

The plate design does not require seat lapping or grinding as with metal plates. The plate 19 can be molded to tolerances of 1 mil.

Figure 4:
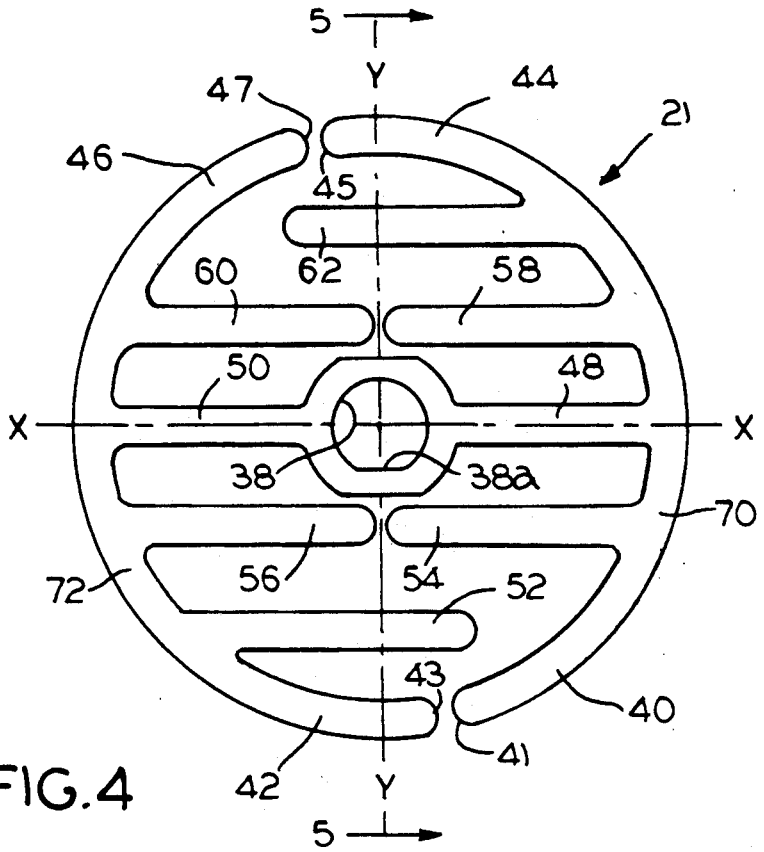
FIG. 4 is a top plan view of a spring plate of the present invention.
Figure 5:
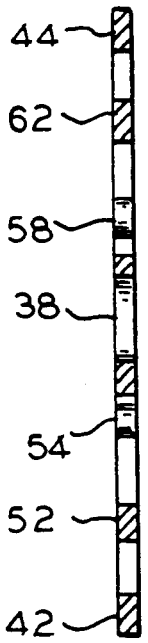
FIG. 5 is a cross-section view taken along lines 5—5 of FIG. 4.

FIG. 1, 4 and 5 illustrate our spring 21. The flat circular spring 21 is located in juxtaposed abutting relationship with plate 19 and has a central portion 36 with an irregular shaped orifice 38 in the center thereof. The key or irregular shaped orifice 38 as shown for illustrative purposes, is generally arcuate with a flat side 38*a* which acts as guide or key surface. An arm 48 extends radially from the central portion 36 to an arcuate rim portion 70. Arcuate rim 70 has a predetermined width. The rim 70 extends generally less than ½ the circumference of the spring. The rim 70 has on opposite ends thereof arcuate spring fingers 40 and 44 each having ends 41 and 45 respectively.

An arm 50 extends radially from the central portion 36 and preferably opposite from and in diametric alignment with arm 48. The arm 50 extends to a second arcuate rim portion 72 which is opposite the rim 70 and has the same diameter and size as arcuate rim 70. The rim 72 likewise, extends generally less than ½ the circumference of the spring and has on opposite ends thereof, arcuate spring fingers 42 and 46 each having ends 43 and 47 respectively.

The end 41 is spaced a predetermined distance from the end 43 and the end 45 is spaced a predetermined distance from the end 47. Spring finger 40 is diametrically opposite spring finger 46 and each preferably have approximately the same arc. Spring finger 42 is diametrically opposite spring finger 44 and each preferably have approximately the same arc.

A chordal or linear spring finger 52 extends chordally and inwardly from rim 72 adjacent the arcuate spring finger 42 and extends beyond the Y axis. A diametrically opposite chord or linear spring finger 62 extends chordally and inwardly from rim 72 adjacent opposite arcuate spring finger 44. Spring finger 62 extends beyond the Y axis. Spring fingers 52 and 62 have the same length and same spring load.

A first pair of chord spring fingers 54 and 56 extend toward each other from their respective rims 70 and 72 and having ends 55 and 57 spaced a predetermined distance from each other. The chord fingers 54 and 56 extend parallel to and between the arms 48 and 50 and the spring finger 52.

A second pair of chord spring fingers 58 and 60 extending toward each other from their respective rims 70 and 72 and have ends 61 and 63 respectively spaced a predetermined distance from each other. The chord fingers 58 and 60 extend parallel to and between the arms 48 and 50 and the spring finger 62.

Although the spring fingers 54 and 56 and spring fingers 58 and 60 are preferred to be the same size, it is desired to adjust the spring tension they may be of a different size. However, in that instance it is preferred that the diametrically opposite fingers 56 and 58 have the same size and that the diametrically opposite fingers 54 and 60 have the same size.

The configuration and number of chord spring fingers is determined by the spring tension desired. The use of linear or chord extending spring fingers 52, 56, 58, 60 and 62 tends to limit and soften the plate impact when opening of the fluid passage ports.

Circular spring plate 21 is one piece and is preferably stamped from 17-7 pH stainless steel, heat treated, and peened. The stamping process is more easily facilitated because the spring fingers extend in a linear direction.

The arcuate nubs o projections 31 and 32 are positioned such that their flat top surface engages end 41 and 43 and 45 and 47 of their respective fingers when the spring fingers are slightly flexed for preload and the valve is closed.

This is the position of the nubs 3 and 36 with respect to spring fingers 52 and 62 and the position of nubs 33 and 34 with respect to fingers 54, 56, 58 and 60.

The sloping sides 100, 102, and 103 of the spring nubs are usually in contact with a portion of the corresponding spring fingers when the valve is in its open position. In its normal sealing position, the movable plate 19 is pressed against the seat 17 by the resilient spring 21. The land areas on the plate bottom surface seal the linear or chord passage ports 20, 22, 24, 26, 28 and 30. When the movable plate moves towards guard 16 and bends the spring fingers, the sloping or tapered surfaces 100, 102, and 103 of the circular and linear projections provide more than a line contact support. The tapered surfaces help to control the rate of change of spring pressure by shifting the contact point with the spring toward its fixed end. The heights of the projections control the lift. The projections may have identical heights or, if desired, may have different heights to create a variable pressure on plate 19 with change in distance of movement of plate 19.

As many resilient spring fingers can be added or removed as needed for a particular valve. The lengths of the spring fingers effect the force exerted by the spring plate and also determine the position of the corresponding projections on the movable plate 19. In addition, the force exerted by the spring plate 21 varies with the number of spring fingers. For example, the spring fingers can be easily snipped off to decrease the force of the spring plate.

The geometric configuration of the valve spring, plate and seat allows the valve plate and spring to be used across a range of sizes. For instance, the same plate and spring can be used across a range of sizes of 4.75 inch to 4.25 inch diameters with total parts commonality.

The only additional operations required would be machining down the outer diameter and machining in a seating groove.

FIGS. 1, 9 and 10 illustrate one annular guard 16. The guard 16 is generally comprised of an annular rim 74, central arms 76, and a central portion 78 defining an irregular shaped orifice 80 having a flat key side 81. Depending on the location of the linear resilient spring fingers 52–62, the guard may also have truncated or triangular surfaces 82 and 84 which, together with the rim and central portion, prevent upward fly of the spring fingers 40, 42, 44, 46, 52, and 62. Preferably guard 16 is stamped from 17-7 pH stainless steel, heat treated, and peened.

A steering stud 86, a washer 88, and a screw 90 combine with parts 17, 19, 21 and 16 to form a unitary structure. Steering stud 86 includes a bore 68. The steering stud has an outside irregular shaped circumference 87 which is slightly less than the irregular shaped circumference of the valve plate orifice 15 and seat orifice 76. The steering stud 86 has an inner raised portion 88 which has an irregular outer circumference which is equal to or slightly less than the irregular circumference of the spring orifice 38 and guard orifice 80. The height of the raised inner portion 88 is sufficient to accommodate the depth or thickness of the guard and spring preferably so that the washer 89 will hold the guard and spring tightly onto the steering stud 86. The steering stud rests in bore 76 of seat 17 and is surrounded by the movable plate 19. The moveable plate moves axially along the stud. The flat spring 21 rests on stud shoulder 70 and the guard 16 rests on the spring 21. The bores 18 and 68 receive screw 90. Stud 86 may be fabricated from powdered metal.

Preferably, stud 86, bore 76 of seat 17, orifice 15 of plate 19, orifice 38 of spring plate 21, and orifice 80 of guard 16 have irregular but similar configurations. The irregular configuration performs a key function which prevents rotation of the seat, plate, spring plate and guard relative to each other and aligns each with regard to each other. Further, the steering stud determines the lift. The steering stud provides for easy variation in lift and the addition of more springs by simply interchanging steering stubs.

In operation, either as a pressure valve or a suction valve, bottom of plate 19 rests on to top of seat 17 and seals fluid ports 20, 22, 24, 26, 28 and 30. The spring fingers 40–46 and 52–62 of flat spring 21 rest on corresponding projections 32, 34 and 35 of the movable plate 19 thus biasing the plate 19 against valve seat 17 to securely seal the seat fluid ports. When the pressure of the fluid in the seat fluid ports becomes sufficiently great, either due to pressure or suction from the reciprocating compressor, the plate 19 is forced away from seat 17 and guided by the steering stud 86 towards flat spring 21 and guard 16 and flexes or bends the resilient spring fingers upwards away from the seat 10. The inclined sides of the projections come into contact with the spring fingers. The spring fingers are raised through the openings in the guard 16. Thus, plate 19 is allowed to move toward flat spring 21 and guard 16 even though the central portion 36 of flat spring 21 is held stationary or fixed with respect to seat 17 by stud 86. This action, of course, uniformly opens the seat fluid ports and allows the fluid to pass through seat fluid ports and valve plate ports. With this arrangement of the plate 19, spring 21, seat 17 and guard 16, the plate 21 can move up to 0.210 inches. In addition, as the plate 21 moves against the spring fingers, the sloping shoulders or sides of the projections shift their points of contact with the spring fingers toward their fixed ends thereby causing a rapid increase of spring finger pressure on plate 19 to aid in halting the movement of the plate 19.

When the pressure in the linear passage ports is reduced sufficiently to a level below that force generated by the resilient spring fingers, the movable plate 19 is returned to its normal sealing position.

While the invention has been described in relation to a preferred embodiment thereof, those skilled in the art may develop a wide variation of structural details without departing from the principles of the invention. Therefore, the appended claims are to be construed to cover all equivalents falling within the true scope and spirit of the invention.

I claim:

1. A compressor plate valve comprising:

a valve seat, said valve seat having a flat circular top surface defining a plurality of linear extending seat fluid ports, each seat fluid port having ends spaced a predetermined distance inwardly from an outer edge of said top valve surface;

at least one movable valve plate positioned about said seat, a plurality of linear extending plate ports spaced a predetermined distance apart and spaced a predetermined distance from the periphery of said valve plate, said plate having a flat bottom surface and a top surface, a plurality of linear projections extending from said top surface of said plate and spaced a predetermined distance apart;

at least one valve spring positioned above said valve plate, said spring having a plurality of linear extending spring fingers, said fingers being in operative contact with said plate projections to urge said plate in sealing engagement with said seat; and a guard means positioned above said spring; said guard having a rim, an arm extending between said rim, an irregular shaped mounting orifice formed in a center of said arm, said arm being a predetermined distance below said rim, and a pair of stop surfaces extending inwardly from opposite sides of said rim.

2. The plate valve of claim 1 wherein said valve plate ports are arranged to correspond to said seat ports; and said spring fingers are geometrically arranged wherein each spring finger has a corresponding spring finger of equal size and which is diametrically opposite.

3. The plate valve of claim 1 wherein said seat has linear fluid ports with a first and second fluid port extending chordally and parallel to each other on opposite sides of the valve seat center, said first and second ports being a predetermined distance from the valve seat center;

third and fourth fluid ports extending chordally and parallel to each other on opposite sides of the valve seat center, said third and fourth ports being a predetermined distance from the valve seat center; and fifth and sixth fluid ports extending radially from opposite sides of said valve center and spaced a predetermined distance from said valve center.

4. The plate valve of claim 3 wherein the first and second ports extend parallel to the third, fourth, fifth and sixth ports; the first and second ports are the same size, the third and fourth ports are the same size, and the fifth and sixth ports are the same size.

5. The plate valve of claim 1 wherein the valve plate is a molded one-piece polyether-ether-ketone polymer reinformed with 30% by weight glass fiber.

6. The plate valve of claim 1 wherein said valve plate has at least two arcuate projections extending from the outer periphery of the valve plate top surface, and said linear and arcuate projections being geometrically arranged, and each projection has a projection flat top face and inclined projection sides which slant from opposite end of the projection top face downwardly towards the plate top surface.

7. The plate valve of claim 1 wherein the valve plate top surface has an X axis and a Y axis perpendicular to the X axis;

a pair of diametrically opposite arcuate projections extending from the outer periphery of said plate and each having a flat top surface on opposite sides of the X axis and the Y axis;

a second pair of chordally extending projections with a top flat surface of each being on opposite sides of the X axis and the Y axis;

a third pair of chordally extending projections with the top flat surface of each being intersected by the Y axis and on opposite sides of the X axis;

a first pair of plate fluid ports on opposite sides of said X axis between said arcuate projections and said second pair of projections;

a second pair of plate fluid ports on opposite sides of said X axis between said second pair and third pair of projections;

a third pair of plate fluid ports and a fourth pair of plate fluid ports on opposite sides of said X axis between said third pair of projections.

8. The plate valve of claim 1 wherein said spring is circular and said spring fingers are geometrically arranged wherein each spring finger has a corresponding spring finger of equal size and diametrically opposite; and said valve plate has projections corresponding which are geometrically arranged wherein each projection has a corresponding projection of equal size and diametrically opposite.

9. The plate valve of claim 1 wherein said spring has at least two arcuate spring fingers formed by the periphery of said spring, first and second chordally extending spring fingers on opposite sides of a spring X axis and with free ends of the first and second fingers on opposite sides of a spring Y axis, third and fourth chordally extending spring fingers on opposite sides of said spring X axis and with free ends of the third and fourth finger on opposite sides of said spring Y axis, and fifth and sixth chordally extending spring fingers on opposite sides of said spring X axis and with their free ends on opposite sides of spring Y axis.

10. The valve of claim 6 wherein said guard rim is flat and annular and said step surfaces being triangular surfaces.

11. The valve seat for a compressor plate valve comprising:

a circular top valve surface defining a plurality of linear extending fluid ports each fluid port having ends spaced a predetermined distance inwardly from an outer edge of said top valve surface, wherein there are six linear fluid ports with a first and second fluid port extending chordally and parallel to each other on opposite sides of the valve seat center, and said first and second ports being a predetermined distance from the valve seat center;

third and fourth fluid ports extending chordally and parallel to each other on opposite sides of the valve seat center, and said third and fourth ports being a predetermined distance from the valve seat center, and fifth and sixth fluid ports extending radially from opposite sides of said valve center and spaced a predetermined distance from said valve center.

12. The valve seat of claim 11 wherein the first and second ports extend parallel to the third, fourth, fifth and sixth ports; the first and second ports are the same size, the third and fourth ports are the same size, and the fifth and sixth ports are the same size.

13. A valve plate for a compressor plate valve comprising:

a flat bottom surface, a plurality of linear extending ports spaced a predetermined distance apart and spaced a predetermined distance from the periphery of said valve plate; and a plurality of linear extending projections extending from a top surface of said plate.

14. The valve plate of claim 13 which is circular and has each projection has a projection flat top face and projection sides slanting from opposite ends of the projection top face downwardly towards the plate top surface.

15. The valve plate of claim 17 wherein the projections and valve ports are geometrically arranged wherein each port and each projection has a corresponding port and projection of equal size and diametrically opposite.

16. The valve plate of claim 14 wherein the valve plate top surface has an X axis and a Y axis perpendicular to the X axis, a first pair of arcuate projections being on opposite sides of the X axis and the Y axis;

a second pair of chordally extending projections with the top flat surface of each being on opposite sides of the X axis and the Y axis;

a third pair of chordally extending projections with the top flat surface of each being on the Y axis and on opposite sides of the X axis;

a first pair of plate fluid ports on opposite sides of said X axis between said arcuate projections and said second pair of projections;

a second pair of plate fluid ports on opposite sides of said X axis between said second pair and third pair of projections;

a third pair of plate fluid ports and a fourth pair of plate fluid ports on opposite sides of said X axis between said third pair of projections.

17. A flat one-piece circular spring and a compressor plate valve comprising:

a plurality of linear extending spring fingers, said spring fingers being geometrically arranged wherein each spring finger has a corresponding spring finger of equal size and diametrically opposite, and said spring bearing against said valve plate which has projections corresponding to said spring and which are geometrically arranged wherein each projection has a corresponding projection of equal size and which is diametrically opposite.

18. The spring of claim 17 further comprising at least two arcuate spring fingers formed by the periphery of said spring, first and second chordally extending spring fingers on opposite sides of a spring X axis and with their free ends on opposite sides of a spring Y axis, third and fourth chordally extending spring fingers on opposite sides of spring X axis and with their free ends on opposite sides of said Y axis, and fifth and sixth chordally extending spring fingers on opposite sides of said spring X axis and with their free ends on opposite sides of said spring Y axis.

19. A circular vestial guard for a compressor plate valve comprising:

an annular flat rim, a central arm diametrically extending between said annular rim, an irregular shaped mounting orifice formed in a center of said central arm, said central arm center being a predetermined distance below said annular rim, and a pair of truncated step surfaces extending inwardly from opposite sides-of said annular rim.

20. In a compressor suction or pressure plate valve having a seat member and a movable plate member comprising:

said seat member having a plurality of linear fluid passage seat ports therethrough;

said movable plate member having a surface area for juxtaposed sealing engagement with said seat ports, said plate member having a plurality of linear fluid passage plate ports; and at least one projection integrally formed on said plate member and extending outwardly from said plate member in a direction away from said plate member for receiving a resilient flat spring biasing said plate member against said seat ports to seal said seat ports.

21. In the valve of claim 20, wherein said spring member comprises:

a flat spring plate in juxtaposed abutting relationship with said plate member, said spring having at least one resilient linearly extending flat spring finger resting on a corresponding one of said plate projections for holding said plate member in sealing engagement with said seat ports;

means for holding said spring plate in a fixed position with respect to said seat member such that when a predetermined pressure in said seat ports forces said movable plate member toward said spring, the projection bends said at least one spring finger and open said seat ports to allow fluid to pass through the valve including said seat member and said plate ports, and said at least one spring finger returning said plate member to its original sealing position when said fluid pressure is reduced by a predetermined amount.

22. In the valve of claim 21 wherein said flat spring includes at least one arcuate rim member and at least one linear spring finger extending in a linear direction inwardly from said rim.

23. In the valve of claim 22 wherein said arcuate rim member has two ends which each end forming a resilient spring finger.

24. In the valve of claim 23 wherein said plate member is constructed of glass reinformed poly-ether-ether ketone polymer.

25. In the valve of claim 21 wherein at least one projection is located near a rim of said plate member and extends in an arcuate direction.

26. In the valve of claim 21 wherein at least one projection extends in a linear direction on said surface area of said plate member.

* * * * *